US009149916B2

(12) United States Patent
Kiser

(10) Patent No.: US 9,149,916 B2
(45) Date of Patent: Oct. 6, 2015

(54) GEAR HEAD SOCKET TOOL

(71) Applicant: Cody Kiser, Madison, IN (US)

(72) Inventor: Cody Kiser, Madison, IN (US)

( * ) Notice: Subject to any disclaimer, the term of this patent is extended or adjusted under 35 U.S.C. 154(b) by 166 days.

(21) Appl. No.: 13/694,785

(22) Filed: Jan. 4, 2013

(65) Prior Publication Data

US 2014/0190315 A1 Jul. 10, 2014

(51) Int. Cl.
*B25B 13/48* (2006.01)
*B25B 17/00* (2006.01)

(52) U.S. Cl.
CPC ..... *B25B 13/481* (2013.01); *B25B 17/00* (2013.01)

(58) Field of Classification Search
CPC ..... B25B 17/00; B25B 13/481
USPC ..... 81/57.12, 57.13, 57.28, 57.29, 57.42, 81/57.45, 121.1
See application file for complete search history.

(56) References Cited

U.S. PATENT DOCUMENTS

| | | | | | |
|---|---|---|---|---|---|
| 1,299,591 | A | | 4/1919 | Malchow | |
| 1,333,532 | A | | 3/1920 | Berk | |
| 1,494,200 | A | | 5/1924 | Waters | |
| 2,206,802 | A | * | 7/1940 | Brenning | 81/57.29 |
| 2,429,569 | A | | 10/1947 | Stewart | |
| 2,906,153 | A | * | 9/1959 | Erb | 81/57.29 |
| 3,532,012 | A | * | 10/1970 | Pryor | 81/57.29 |
| 4,240,310 | A | * | 12/1980 | Roth | 81/57.29 |
| 4,813,308 | A | | 3/1989 | Petrus | |
| 4,913,007 | A | | 4/1990 | Reynolds | |
| 5,058,463 | A | * | 10/1991 | Wannop | 81/57.29 |
| 5,345,845 | A | * | 9/1994 | Myers | 81/57.29 |
| 5,365,807 | A | | 11/1994 | Darrah et al. | |
| 5,630,343 | A | * | 5/1997 | Begin | 81/57.46 |
| 5,709,136 | A | * | 1/1998 | Frenkel | 81/57.13 |
| 6,216,562 | B1 | | 4/2001 | Hsieh | |
| 7,089,827 | B2 | * | 8/2006 | Wexler | 81/57.29 |
| 7,171,872 | B1 | | 2/2007 | Keusch | |
| 7,340,981 | B1 | | 3/2008 | Walter | |
| 7,500,412 | B1 | * | 3/2009 | Maciejewski | 74/424.71 |
| 7,571,668 | B1 | * | 8/2009 | Chang | 81/57.29 |
| 7,874,233 | B1 | * | 1/2011 | Taylor | 81/177.2 |
| 2004/0211299 | A1 | * | 10/2004 | Chen | 81/121.1 |
| 2007/0022847 | A1 | * | 2/2007 | Chen | 81/180.1 |
| 2009/0217789 | A1 | * | 9/2009 | Chang | 81/60 |
| 2012/0297939 | A1 | * | 11/2012 | Spata | 81/478 |

* cited by examiner

*Primary Examiner* — David B Thomas
(74) *Attorney, Agent, or Firm* — Carrithers Law Office PLLC

(57) ABSTRACT

A non-ratcheting socket tool for loosening or tightening nuts or bolts, especially when the nut or bolt head is located in a crowded area where there is inadequate space to pivot or rotate a handle of a wrench or ratchet. The gear head socket tool includes a slim streamlined housing including a straight beveled gear coaxially arranged around a sleeve or ring having a plurality of internal nut/bolt gripping wrench teeth, wherein the straight beveled gear teeth mate with beveled pinion gear teeth perpendicular thereto. An extension bar is inserted into the end of the gear head housing perpendicular to the gear head. Rotation of the extension bar with a ratchet, a breaker bar, strong arm or a power tool such as a pneumatic or electric impact wrench, or drill motor provides perpendicular torque to drive the gear head socket rotating the teeth turning the nut or bolt.

4 Claims, 4 Drawing Sheets

GEAR HEAD SOCKET TOOL

TECHNICAL FIELD

The present invention relates to the field of ratchet tools used to loosen and tighten nuts and bolts, especially tools configured for use in areas with limited space where normally used wrenches, ratchets, and/or sockets with extensions will not fit or are not able to be manipulated.

BACKGROUND OF THE INVENTION

Many different tools are well known in the art for tightening and loosening nuts and bolts. Simple open end and box end wrenches have been used for decades. Pliers, slip joint pliers and adjustable wrenches are also well known. Interchangeable sockets which can be applied to ratchets provide a quicker method to tighten or loosen and remove nuts and bolts holding various mechanical devices together. Such a gear head socket tool provides the ability to drive a socket which is applied to a nut or bolt either clockwise or counterclockwise without the need to remove the socket from the nut or bolt after rotating the ratchet handle by a selected angle. However, situations arise wherein there is not enough room to connect a ratchet to a socket engaging a nut or bolt and to rotate a wrench or ratchet handle.

DESCRIPTION OF THE RELATED ART

U.S. Pat. No. 1,492,200 by Waters for WRENCH which issued on May 14, 1924 teaches a 90 degree angle drive using bevel gears and driven by a gear box with a hand crank. Waters includes interchangeable sockets which are inserted into his drive mechanism.

British Publication No. GB2460251 by Fossett for ADAPTER FOR TOOL which published on Oct. 25, 2009 teaches a 90 degree angle drive using bevel gears and includes a square socket at the center of the input gear for connecting to a driving tool such as a ratchet or extension bar, and a square lug on the output gear for connecting to a socket. The socket is not an integral part of the output gear and the fastener cannot extend through the socket.

U.S. Pat. No. 6,216 by Hsieh discloses a 90 degree drive which may be a "T" shaped or "L" shaped drive and uses springs to force the bevel gears toward each other to ensure positive driving of the gears.

U.S. Pat. No. 5,365,807 by Darrah et al. Teaches a through hole socket.

U.S. Pat. No. 1,333,532 by Berk for WRENCH issued on Mar. 9, 1920 teaches a 90 degree angle drive with a gear box using bevel gears with an input shaft and an output shaft. The input shaft is driven with a crank handle and a socket may be applied to the output shaft as opposed to the present invention wherein the socket is integral with the output gear. Berk's design does not permit the fastener to extend through the socket.

SUMMARY OF THE INVENTION

The present invention combines a socket with a non-ratcheting gear head drive wherein the drive is perpendicular to the longitudinal axis of the fastener and the ratcheting motion of the gear head drive is transmitted to the socket via a beveled pinion gear that mates up with a straight bevel gear on the socket. The design allows the user to utilize the tool whether a standard socket or a deep socket may be required as the fastener may project through the socket itself.

In accordance with the present invention, there is provided a device comprising, consisting of, or consisting essentially of a socket having a plurality of teeth therein, a ring gear in coaxially encircling a selected open end of the socket, and a pinion gear drive disposed perpendicular thereto engaging a drive means enclosed within a head casing or a housing. The socket includes an integral coaxial ring gear with a plurality of spaced apart first beveled teeth spaced apart around a lower periphery of the outside surface and has both ends open for cooperatively engaging a nut or bolt. The socket is configured to removably and tightly accept a hexagonal nut or bolt head of a selected size. The pinion gear has beveled teeth configured to drive the beveled teeth of the ring gear via perpendicular torque. The pinion gear is coaxial and integral with a pinion shaft and a drive head. The drive head has a square cavity formed therein which is capable of removably accepting a square drive lug at the end of a selected extension bar. The housing rotatably holds the socket and the ring gear in mesh with the pinion gear. The socket has both open ends exposed with respect to the housing. The square cavity of the first drive head is exposed at one end of the housing.

It is an object of this invention to provide a tool which can be used to loosen or tighten a nut or bolt head by rotating an input shaft which is at a 90 degree angle with the axis of the nut or bolt.

It is an object of this invention to provide a tool which can be used to loosen or tighten a nut or bolt head especially when there is very little room to rotate a wrench which can be applied to the nut or bolt head.

It is an object of the invention to provide a gear head tool which includes a universal driving means to accommodate a long drive extension as compared to a convention box end or ratchet wrench.

It is another object of the present invention to utilize a knuckle in order to between the gear head and handle portion to provide a means to address additional angles.

It is another object of the present invention to provide a gear head tool which can be operated in a restricted environment wherein a nut can be loosened or tightened by the tool without any arcing movement in that the tool does not require an arc of operation.

It is another object of the present invention to provide a compact and slim housing or head casing to hold the gear mechanism and drive teeth as compared to a conventional socket wrench.

It is an object of this invention to provide a tool which can be used to loosen or tighten a nut or bolt head especially when there is very little room in an axial direction above the nut or bolt head to use a 90 degree angle drive tool.

It is an object of this invention to provide a tool which can be used to loosen or tighten a nut or bolt head wherein the tool includes a socket which is open on each end and will therefore allow the nut or bolt head to slip axially into one end and out of the other end of the socket.

It is an object of this invention to provide a tool which can be used to loosen or tighten a nut or bolt head wherein the socket of the tool can receive and hold an insert capable of receiving and holding selected interchangeable sockets of various sizes.

More particularly, the present invention comprises, consist essentially of, and/or consists of a non-ratcheting gear head tool for loosening or tightening nuts or bolts, especially when the nut or bolt head is located in a crowded area where there is inadequate space to pivot or rotate a handle of a wrench or ratchet. The gear head socket tool includes a slim streamlined housing including a ring or sleeve of inwardly disposed teeth which fit coaxially over the bolt or nut to be tightened or loosened, and a square ended extension bar is inserted into the end of the tool perpendicular to the gear head. Rotation of the extension bar with a ratchet, a breaker bar, strong arm or a power tool such as a pneumatic or electric impact wrench, or drill motor provides perpendicular torque to drive the gear head socket rotating the teeth turning the nut or bolt.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a gear head socket tool 10 including a pinion and ring gear driven socket wherein the pinion is in turn preferably driven by an extension bar which is in turn driven by a ratchet, impact wrench drive, drill motor drive, or the like.

Figure 1:
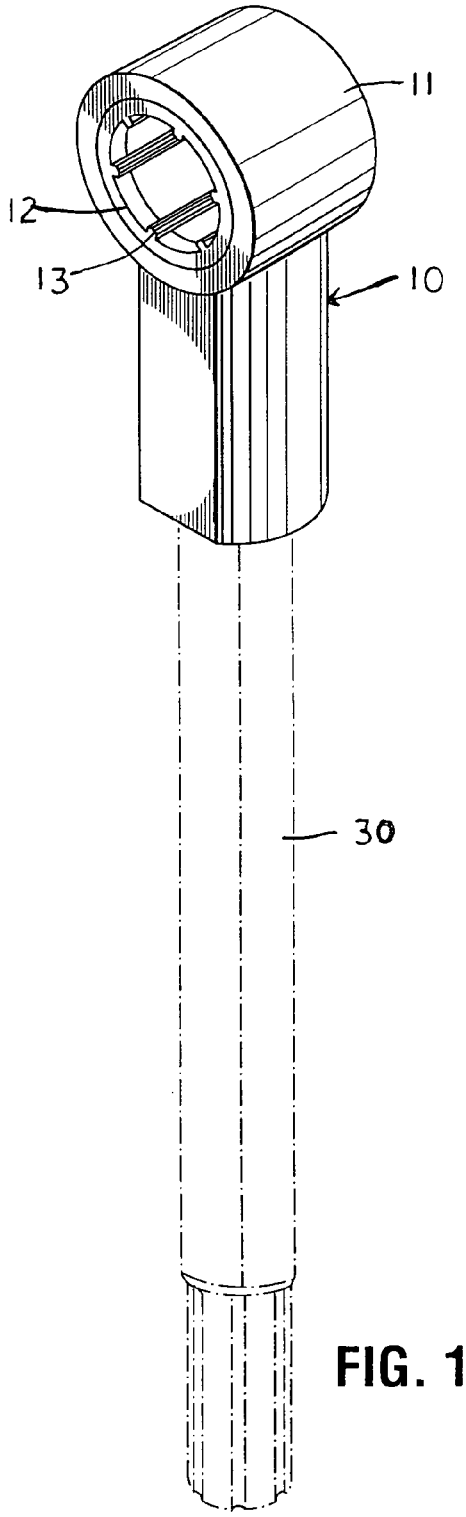
FIG. 1 is a perspective view of the gear head socket showing an extension bar in phantom lines.
Figure 8:
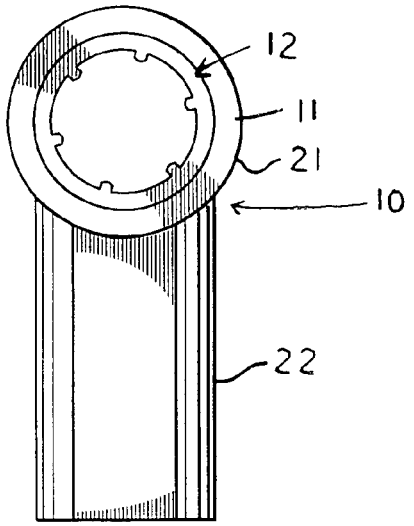
FIG. 8 is a perspective side view of the gear head drive wrench housing showing the housing containing the rotatable sleeve therein.

FIG. 1 is a perspective view showing the housing or head casing 11 and the rotatable socket 12 with a plurality of wrench teeth 13 arranged inside the sleeve or socket protruding from the inner surface 3 and configured to fit a selected hexagonal nut or bolt head. The wrench teeth 13 comprise gripping means comprising ribs, pointed teeth, triangular teeth, rods, longitudinal ridges, grooves, and/or a combination thereof spaced apart and parallel from one another integrally formed on the inner surface 3 of a rotating socket member 12 positioned to extend along a longitudinal axis of the rotatable socket 12 in parallel alignment with the open ends of the socket 12. The socket 12, as shown in the figures is open on each end to allow the socket to be used on a nut, bolt head, and/or other fastener head which has a large length of bolt threads extending outward therefrom. This open ended configuration satisfies a situation that would otherwise require a deep-well socket.

Figure 2:
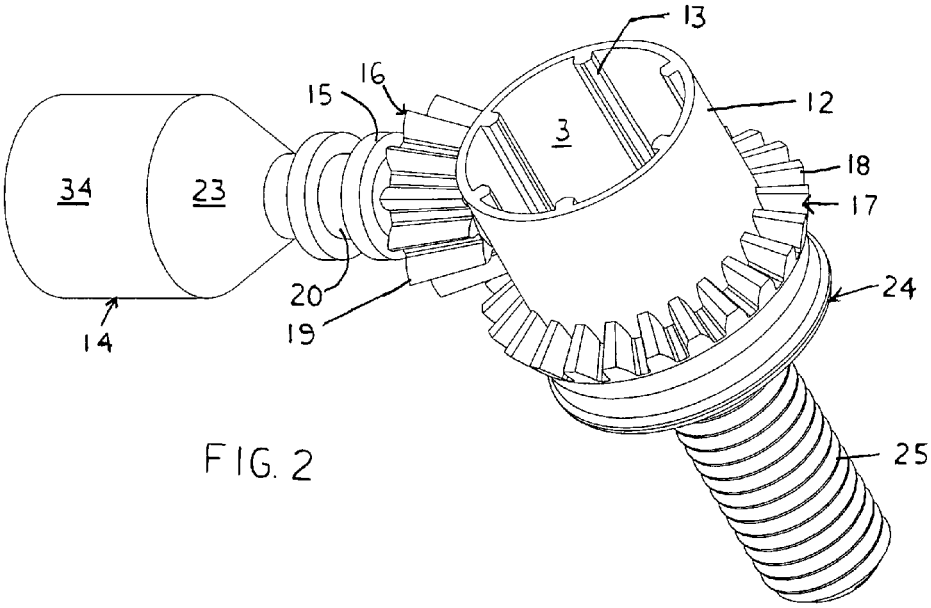
FIG. 2 is a perspective view of the pinion shaft/drive, ring-gear/socket and a bolt inserted into the socket.
Figure 3:
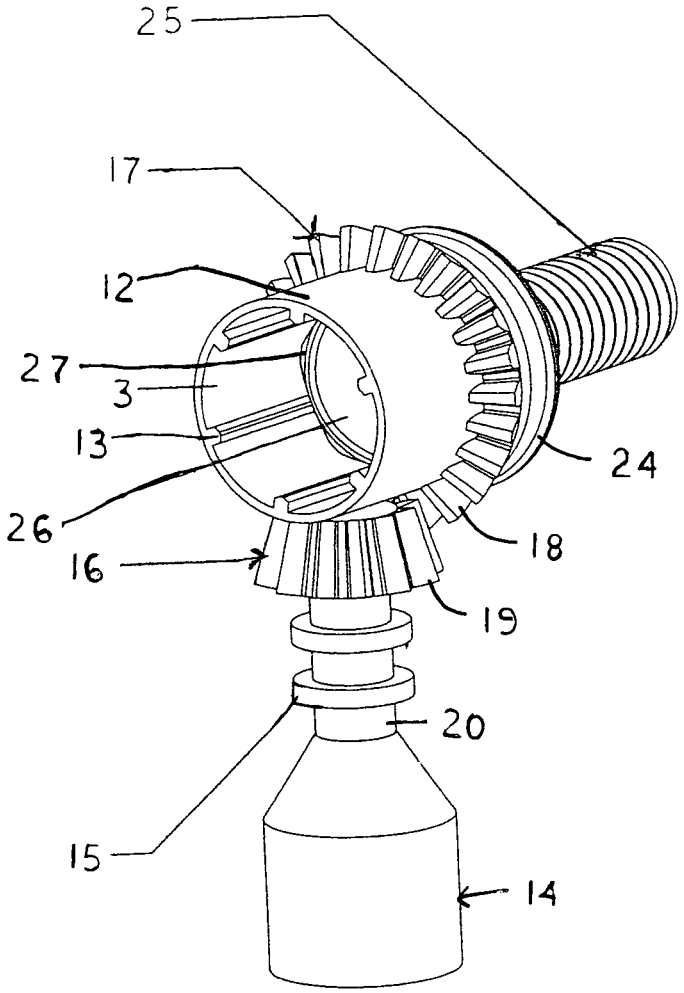
FIG. 3 is a perspective view of the pinion shaft/drive, ring-gear/socket and a bolt inserted into the socket showing the corners of the bolt engaging the wrench teeth of the socket.

With reference to FIGS. 2 and 3, the gear head tool 10 is shown without the housing 11 in cooperative engagement with a fastener, more particularly, a bolt 24 having a threaded shaft 25 extending therefrom and a head 26 disposed within the socket 12 showing the corners 27 of the head 26 held within the wrench teeth 13 of the socket portion 12. A mating straight beveled gear or straight beveled ring gear 17 is shown disposed coaxially affixed to the outer surface of a socket 12 wherein a plurality of spaced apart beveled socket teeth 18 are affixed to an outer periphery of a first end of the socket with the teeth 18 facing inwardly from the edge of the first end of socket 12. A straight beveled pinion gear 16 having beveled drive teeth 19 cooperatively engages and rotates the socket teeth 18 of the socket beveled ring gear 17 wherein the teeth mate in perpendicular alignment.

Figure 7:
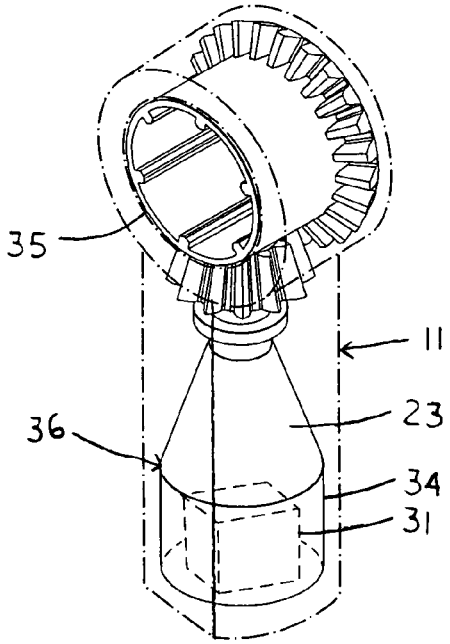
FIG. 7 is a perspective view of the housing and gear assembly of FIG. 5, wherein the gear assembly is enclosed within the housing head and neck in a cooperative relationship.
Figure 9:
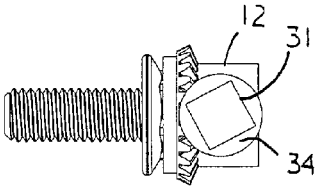
FIG. 9 is a rear end view of the gear head wrench showing the cavity within the drive head sized and shaped to cooperatively engage a drive lug of an extension bar.
Figure 10:
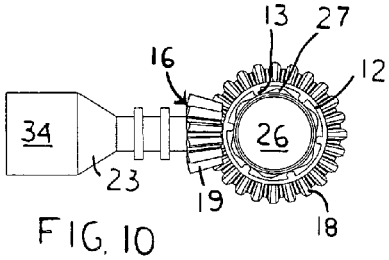
FIG. 10 is a side view of the gear head assembly.
Figure 11:
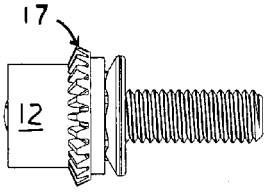
FIG. 11 is a front end view of the gear head showing the sleeve or socket and ring gear assembly.
Figure 4:
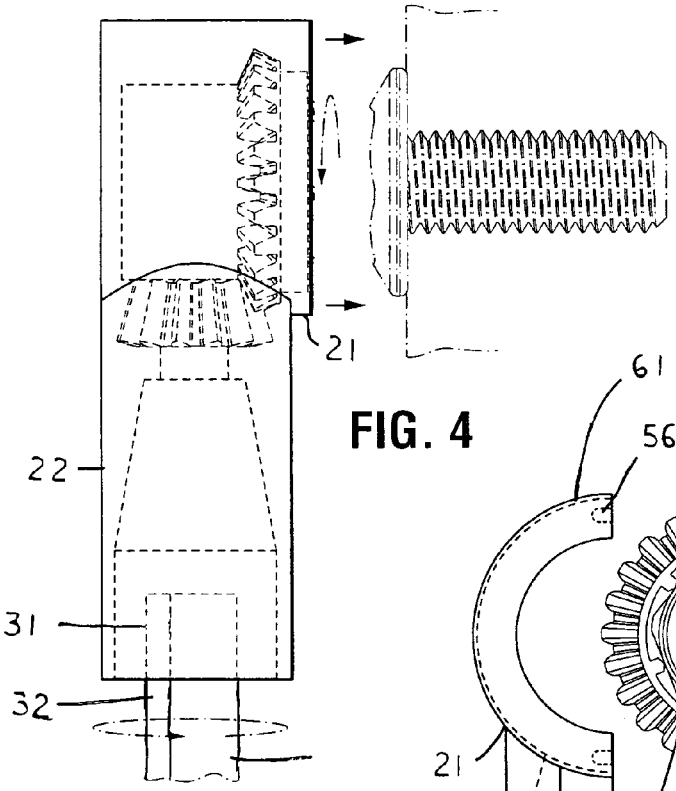
FIG. 4 is a phantom view of the mating of the pinion drive, ring-gear and gear head socket and a bolt head shown in alignment with the gear head socket.
Figure 6:
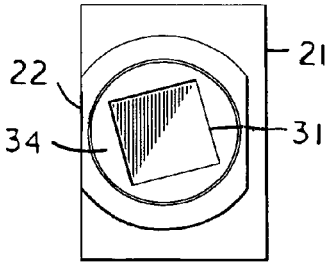
FIG. 6 is an end view of the pinion drive held within the housing.
Figure 5:
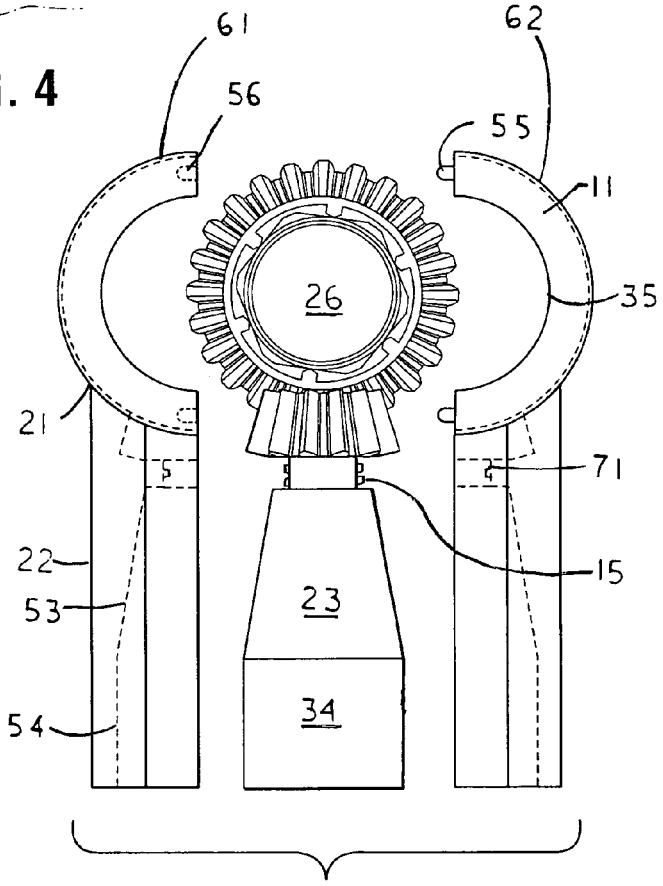
FIG. 5 is an exploded view showing the split housing surrounding the gear drive assembly in phantom view and showing the gear head socket assembly in disposed within in spaced relationship thereto.

The gear head drive is configured and positioned to drive the socket beveled ring gear 17 in one direction or the other as pinion gear 16 is rotated. In the configuration shown, the pinion gear 16 and ring gear 17 are matched bevel gears. Pinion gear 16 is integral with shaft 20, at least one rim 15 and preferably two spaced apart rims 15 extend coaxially around the pinion gear shaft 20 and function as pinion guide means providing bearing surfaces which bear against matching internal wall surfaces 71 within the housing 11 and serve to stabilize the pinion shaft within the housing 11. As illustrated in FIGS. 4, 5, and 7, the gear head wrench drive assembly is held together enclosed within the split shell housing 11 wherein opposing head portions 61 and 62 are cooperatively fitted together and aligned by a plurality of studs 55 cooperatively engaging a plurality of sockets 56 formed at selected points along the housing side walls. The internal wall surface 35 of the head portion 21 of the housing 11 houses the sleeve or socket beveled ring gear assembly 17 which is spaced apart from the walls a selected distance to permit rotation of the gear and socket. The pinion gear assembly 16, shaft 20, frustoconical section 23 and cylindrical drive portion 34 of the drive shaft 36 are disposed within the corresponding mating sections of the neck portion 21 of the housing 11 wherein the pinion gear 16 and shaft 20 are supported by the pinion guide means in rotational relationship with the internal wall surfaces 71 of the housing 11. The frustoconical section 23 is supported in rotational relationship with the internal wall surface 53 of the neck portion 21 and the cylindrical drive portion 34 is supported in rotational relationship with the internal wall surface 54 of neck portion 21. The design and dimensions of the hear head assembly and drive shaft assembly enable the gear head wrench to be fabricated in a slim unit wherein the frustoconical portion, pinion gear shaft and cylindrical drive portion provide the maximum strength within a compact housing unit.

FIGS. 2-8 show additional views of drive head 14 which contains a cavity 31 formed in the cylindrical drive portion 34 of the drive shaft 36 sized and shaped to accept a drive lug 32 at the distal end of a drive means comprising an extension bar 30, screwdriver, strong arm, ratchet, or drill driver having a corresponding sized and shaped drive end which is a square configuration as shown in the illustrations.

The gear head socket is capable of driving a nut or bolt without the need of rotating the housing 11 about the axis of the nut or bolt. This means that as long as a user can get the socket 12 on the nut or bolt, and he can insert an extension bar into the drive head of the pinion shaft, he can turn the extension to tighten or loosen the nut or bolt.

Figure 13:
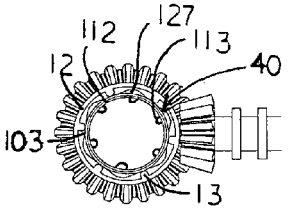
FIG. 13 is a side view showing an annular sleeve disposed within the socket providing means for quick adjustment of socket to correspond to a particular size and shape of different fasteners.
Figure 12:
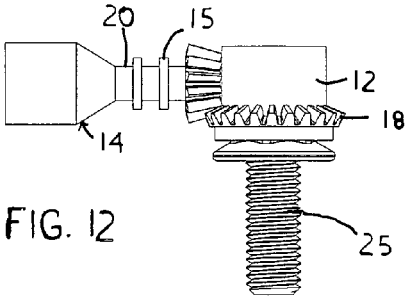
FIG. 12 is a top view of the gear head assembly.

Different gear head sockets or socket inserts are used for different sized nuts or bolts. Socket adapter 40 is insertable into socket 12. As shown best in FIG. 13, an annular cylinder or ring 112 having external gripping means 127 comprising ribs, pointed teeth, triangular teeth, rods, longitudinal ridges, grooves, and/or a combination thereof spaced apart and parallel from one another integrally formed on the outer surface 103 of a rotating socket member 112 of a corresponding size and shape to fit within the sleeve 12, wherein the annular insert 112 is positioned to extend along a longitudinal axis of the rotatable socket 112 in parallel alignment with the open ends of the annular socket 112. Annular cylinder 112 also has internal gripping means 113 comprising ribs, pointed teeth, triangular teeth, rods, longitudinal ridges, grooves, and/or a combination thereof spaced apart and parallel from one another integrally formed on the inner surface 103 of a rotating socket member 112 positioned to extend along a longitudinal axis of the rotatable socket 112 in parallel alignment with the open ends of the annular socket 112 for cooperative engagement with a fastening means such as a nut or bolt 26. The thickness of the annular ring or cylinder 112 may be varied to cooperatively engage fastening means 26 of different sizes or head configurations. Moreover, an annular cylinder 12 having different internal diameters on each end may be used for a selection of the proper size to fit a particular fastener. The annular cylinder may also be a selected shorted length defining a ring with an external diameter sized and shaped to fit within a particular sized and shaped socket 12 and rings 112 of different internal diameters may be used together and inserted into opposing ends of a socket 12 to provide different size sockets.

Moreover, it is contemplated that rings of a selected thickness having external and internal corners may also be inserted within the socket 12 to reduce the size of the socket 12 for cooperative engagement with smaller fasteners.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A gear head socket consisting of:

a socket including an integral ring gear with first beveled teeth defining a beveled ring gear extending around a lower periphery of an outside surface thereof defining a radially outwardly extending flange, said socket having open ends and configured to removably and tightly accept a nut or bolt head of a selected size;

said socket including a plurality of spaced apart beveled ring gear teeth affixed to an outer periphery of said radially outwardly extending flange with said beveled ring gear teeth facing inwardly from the edge of said first end of said beveled ring gear wherein said beveled ring gear is disposed coaxially affixed to the outer surface of said socket;

a pinion gear with second beveled teeth defining a beveled pinion gear configured to drive said first beveled teeth of said beveled ring gear in cooperative engagement therewith wherein said first beveled teeth of said ring gear mate in perpendicular alignment with said second beveled teeth of said beveled ring gear, said beveled pinion gear extending coaxial from a beveled pinion gear shaft having a cylindrical drive head extending therefrom, said drive head having a cavity formed in a distal end thereof, said cavity capable of removably accepting and cooperatively engaging a drive lug at the end of a selected extension bar; and a housing rotatably holding said socket and said beveled ring gear in mesh with said beveled pinion gear, said socket having both open ends exposed with respect to said housing, said cavity of said drive head being exposed at one end of said housing;

a first rim and a second rim extending coaxially around said beveled pinion gear shaft providing bearing surfaces against an internal wall surface of said housing disposed between said beveled pinion gear and said cylindrical drive head;

said beveled pinion gear shaft including a frustoconical section disposed within the corresponding mating sections of a neck portion of said housing supporting said pinion gear shaft in rotational relationship with said internal wall surface of said housing, wherein said frustoconical portion, said beveled pinion gear shaft, said first rim and said second rim, and said cylindrical drive head are rotatably disposed within said housing including a complementary shaped internal wall surface providing maximum strength within said housing.

2. The gear head socket of claim 1 including an insertable and removable socket adapter, said socket adapter having a hexagonal head capable of removably and tightly fitting in said socket, said adapter including a square lug coaxial with said hexagonal head, said square lug sized to removably and tightly hold a standard drive socket.

3. A gear head socket consisting of:

a socket including an integral ring gear with first beveled teeth defining a beveled ring gear extending around a lower periphery of an outside surface thereof defining a radially outwardly extending flange, said socket having open ends and configured to removably and tightly accept a nut or bolt head of a selected size;

said socket including a plurality of spaced apart beveled ring gear teeth affixed to an outer periphery of said radially outwardly extending flange with said beveled ring gear teeth facing inwardly from the edge of said first end of said beveled ring gear wherein said beveled ring gear is disposed coaxially affixed to the outer surface of said socket;

a pinion gear with second beveled teeth defining a beveled pinion gear configured to drive said first beveled teeth of said beveled ring gear in cooperative engagement therewith wherein said first beveled teeth of said ring gear mate in perpendicular alignment with said second beveled teeth of said beveled ring gear, said beveled pinion gear extending coaxial from a beveled pinion gear shaft having a cylindrical drive head extending therefrom, said drive head having a cavity formed in a distal end thereof, said cavity capable of removably accepting and cooperatively engaging a drive lug at the end of a selected extension bar; and a housing rotatably holding said socket and said beveled ring gear in mesh with said beveled pinion gear, said socket having both open ends exposed with respect to said housing, said cavity of said drive head being exposed at one end of said housing;

a first rim and a second rim extending coaxially around said beveled pinion gear shaft providing bearing surfaces against an internal wall surface of said housing disposed between said beveled pinion gear and said cylindrical drive head;

said beveled pinion gear shaft including an interconnecting section disposed within the corresponding mating sections of a neck portion of said housing supporting said pinion gear shaft in rotational relationship with said internal wall surface of said housing, wherein said interconnecting portion, said beveled pinion gear shaft, said first rim and said second rim, and said cylindrical drive head are rotatably disposed within said housing including a complementary shaped internal wall surface providing maximum strength within said housing.

4. The gear head socket of claim 3 including an insertable and removable socket adapter, said socket adapter having a hexagonal head capable of removably and tightly fitting in said socket, said adapter including a square lug coaxial with said hexagonal head, said square lug sized to removably and tightly hold a standard drive socket.

* * * * *